United States Patent [19]

Salvi

[11] Patent Number: 4,892,085

[45] Date of Patent: Jan. 9, 1990

[54] OVEN CLOSURES

[76] Inventor: Francisco J. Salvi, Zuviría 2040, Buenos Aires, Argentina

[21] Appl. No.: 113,124

[22] Filed: Oct. 27, 1987

[30] Foreign Application Priority Data

Oct. 27, 1987 [AR] Argentina ..... 305.701

[51] Int. Cl.[4] ..... F24C 15/16

[52] U.S. Cl. ..... 126/340; 312/273

[58] Field of Search ..... 126/340, 339; 312/273, 312/281, 291, 274, 275, 240

[56] References Cited

U.S. PATENT DOCUMENTS

| | | | |
|---|---|---|---|
| 231,911 | 9/1880 | Holliday | 126/340 |
| 366,733 | 7/1887 | Millett | 126/340 |
| 456,000 | 7/1891 | Graves | 126/340 |
| 839,581 | 12/1906 | Harman | 126/340 |
| 1,632,719 | 6/1927 | White | 126/340 |
| 2,682,263 | 6/1954 | Brodbeck | 126/430 |
| 4,683,871 | 8/1987 | Salvi | 126/340 |

*Primary Examiner*—James C. Yeung

*Attorney, Agent, or Firm*—Burns, Doane, Swecker & Mathis

[57] ABSTRACT

An oven includes a plurality of walls defining an inner chamber. One of the walls is provided with an opening through which access may be had to the inner chamber. The opening includes a vertical axis extending along one side thereof, and a door is pivotally supported along the first vertical axis and is movable between a first door position closing the inner chamber and a second door position opening the inner chamber. The door has an inner door surface exposed to the inner chamber when the door is in the first door position. An inner plate is pivotally supported along a second vertical axis that is parallel to the first vertical axis and located within the inner chamber. The inner plate is movable between a first inner plate position adjacent one of the walls of the oven and a second inner plate position adjacent the opening. The inner plate includes a front surface facing the inner chamber when the inner plate is in the first inner plate position. The oven also includes at least one rack adapted for supporting materials to be heated in the oven. Guides for supporting the rack between the first surface of the inner plate and the inner door surface are arranged so that the door and the inner plate move together with the rack when the door is moved from the first door position to the second door position. When the door is in the second door position the rack is located outside the inner chamber and the chamber is closed by the inner plate. The inner chamber includes a curved chamber surface which is curved about the vertical axis and which is located at a fixed radial distance from the vertical axis.

10 Claims, 2 Drawing Sheets

Fig. 1
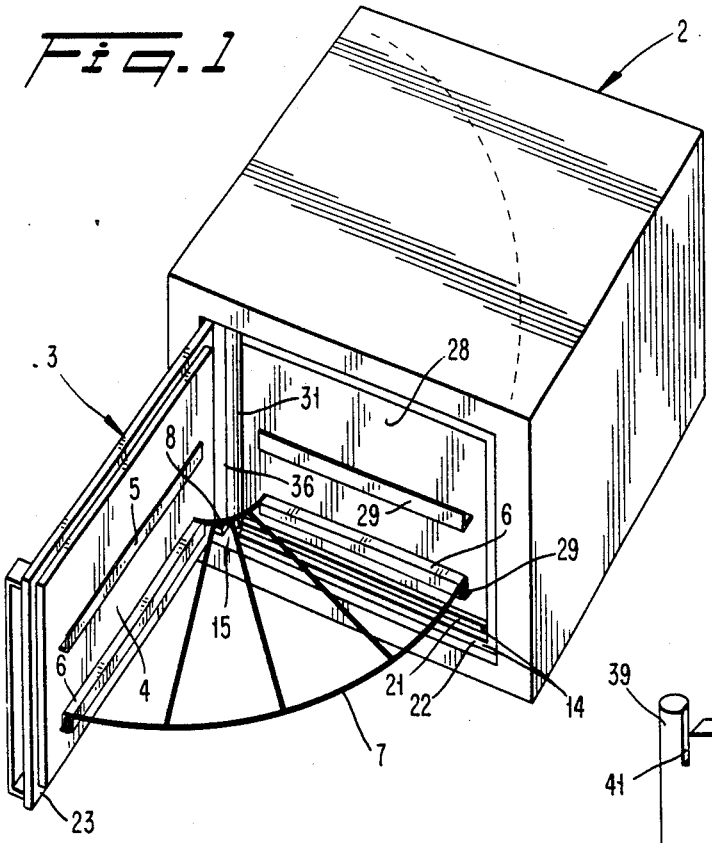
Fig. 3
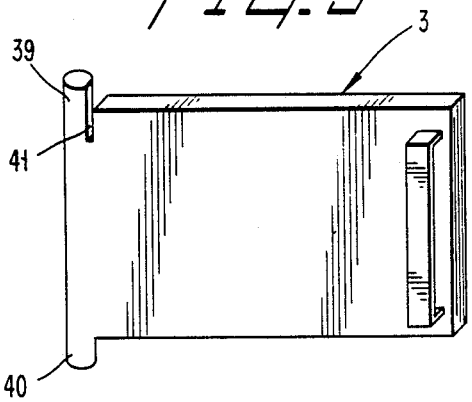
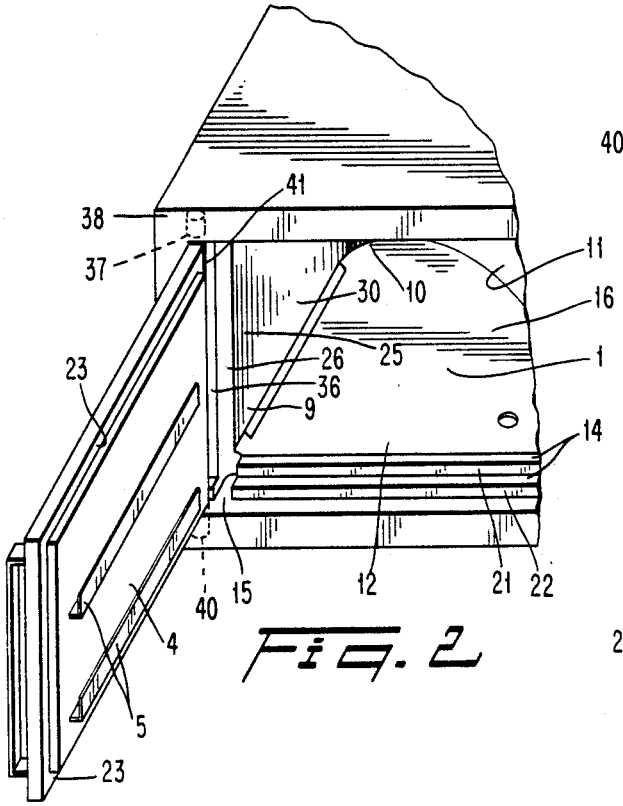
Fig. 2
Fig. 4
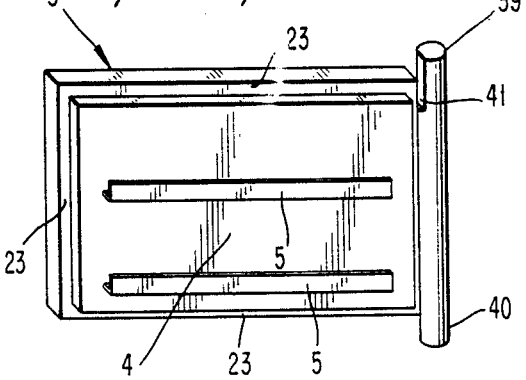

Fig. 5
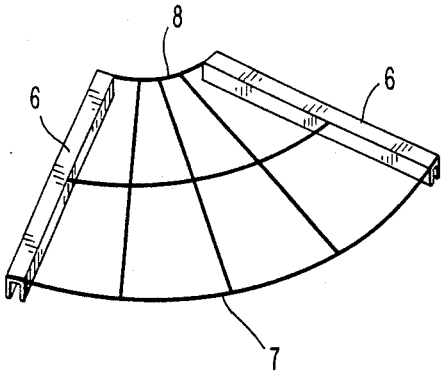
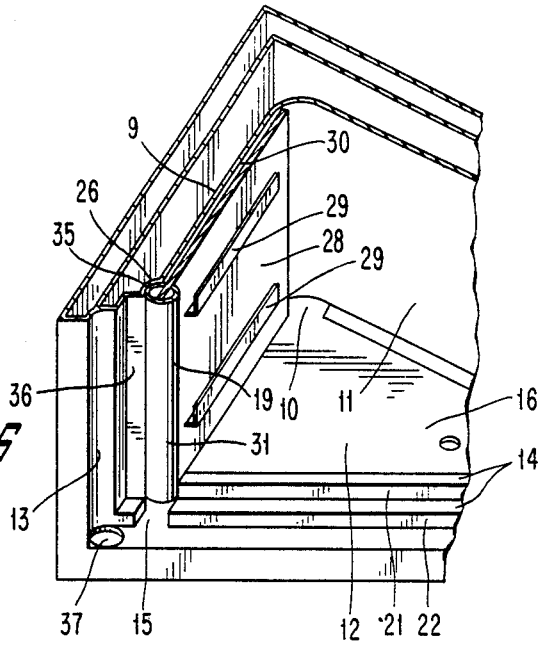
Fig. 6
Fig. 7
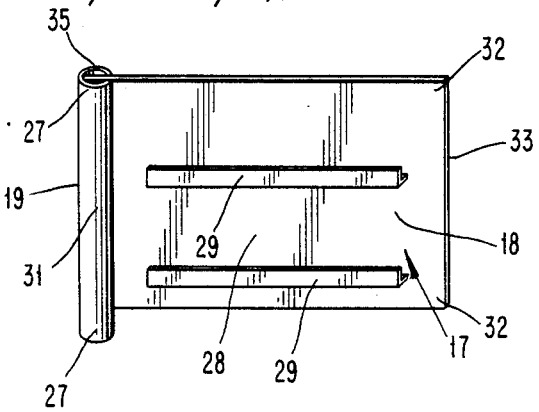
Fig. 8
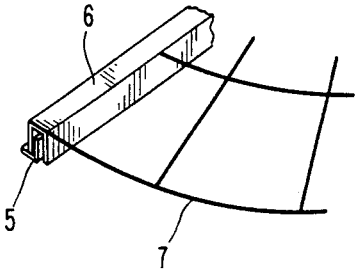
Fig. 9
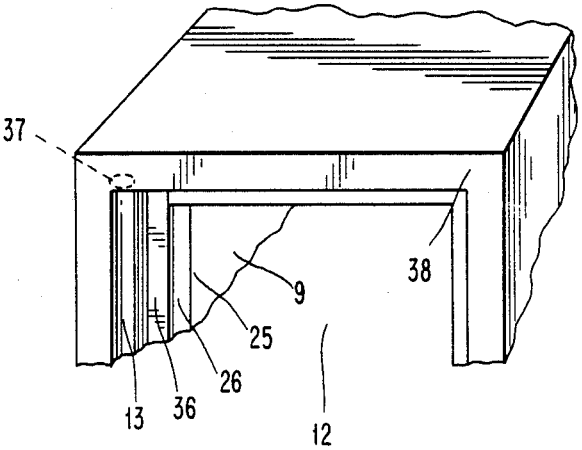
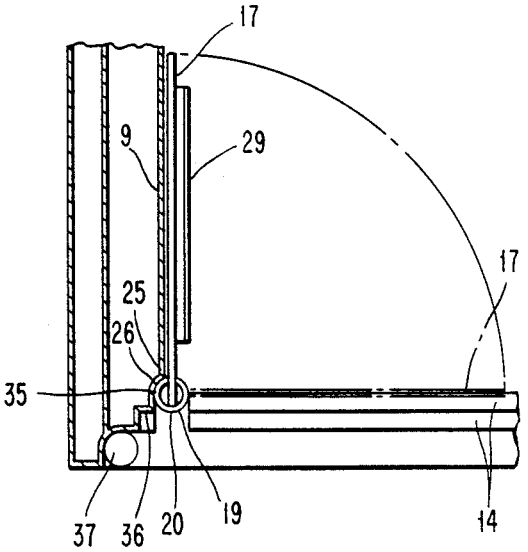
Fig. 10

OVEN CLOSURES

BACKGROUND OF THE INVENTION

1. Field of the Invention

This invention is related to improvements in ovens, and in this case they will be described with respect to an oven having a door that opens by swinging laterally.

The aim of said improvements is to provide an internal closing of said ovens which is achieved automatically and simultaneously with the complete opening of the door by means of a closing plate which is drawn by one or more food racks which can remain in the external part of the oven while the closure prevents the loss of heat through the oven opening while the food is being checked or handled.

2. Description of Related Art

The operation of ovens, particularly the action of opening them to check or handle the food under preparation, presents several disadvantages which are well known, specially by housewives, and consist mainly in uncomfortable heat waves and in drops in the oven's emperature which in turn lead to higher fuel consumption. These disadvantages have not been solved by the prior art.

It is an advantage of this invention, for example, to avoid the unnecessary use of fuel, as well as to prevent the production of heat waves that affect the health of the user of this every-day appliance when its door is opened, either by irritating the skin of her face or by provoking burns on hands or wrists.

The improvements supplied by this invention were introduced by the applicant in view of the above, and are hereinbelow described structurally, demonstrating the way in which they can be put into practice in the specification with the support of the attached drawings.

BRIEF DESCRIPTION OF THE DRAWINGS

FIG. 1 is a perspective view of the oven, through which open door it can be observed that the oven opening can be completely closed by a plate, providing a rack between said plate and said door.

FIG. 2 is a view of a portion of said oven in which the door is also open, but in the absence of the plate which closes the oven opening, and therefore of said rack, thus allowing for an almost complete view of the inside of the oven.

FIG. 3 is a front view of the door of said oven in which its external lines can be observed, particularly of the protruding ends of its axis, as well as of the groove formed in its top edge between part of said edge and the axis.

FIG. 4 is a perspective view of the internal part of said door.

FIG. 5 is a view of one of the removable racks.

FIG. 6 is a perspective view of a portion showing several sections of the internal structure of the baking chamber of said oven, where said closing plate of the oven opening can be seen in its position adjacent to the side wall of said chamber and connected to its own revolving axis.

FIG. 7 is a perspective view of said removable plate or fixed closing plate showing its lateral axis placed internally with respect to the oven opening, and showing its external conformation.

FIG. 8 is a respective view of a lateral front-side end of a rach and its connecting portion to the guiding channel provided on said internal face of the door for their mutual connection. The other end of said rack—not shown—presents a similar connecting portion for its connection to a similar guiding channel provided on the external face of the closing panel.

FIG. 9 is a perspective view of the top portion of said oven, showing an orifice or axle box provided through the top wall of said chamber for housing the top end of said axle, and the opening provided for its introduction into said chamber from said top wall to the internal wall of the insulation compartment.

FIG. 10 is a horizontal section of the arrangement of the respective axes for the pivoting of door 3 and of closing plate 17.

The following description refers to the different parts that conform and define the invention, which are identified by references with respect to the above described drawings, where identical references refer to identical parts.

DETAILED DESCRIPTION OF THE PREFERRED EMBODIMENT

The novelty described herein is conformed by the chamber 1 of an oven 2 which door 3 swings laterally, presenting on its inner face 4 two parallel guiding channels 5 disposed for a free sliding connnection with the corresponding guiding channels 6 which, having an inverted "U" shape, define the straight sides of the respective racks, said sides defining a right angle with an adequate truncation of the vertex 8. Said chamber 1 has an internal structure dfefined by a straight wall 9 (fig.2), a concave angle 10 (shaped so to facilitate access for cleaning) and then a curved wall 11 which ends at the lateral frame which coincides with the lock of the door 3. As can be seen, the surface that forms the inside of said oven 2 does not present any sharp angles or attachments, which imples a further advantage for the housewive, since this facilitates the cleaning of the inside of the oven 2 and thus contributes to the care of her hands.

Continuing with the description of said chamber 1, the feature proposed as principal object hereof is said inner closing or blocking of the opening 12 of the front wall of the oven. by the inner edges of its front opening which present a stepped arrangement of two steps (upper 14 and lower 14) except on the side of the pivoting vertex 13 of the door 3. Said steps are arranged horizontally and parallel and they present, just next to said pivoting vertex 13, an opening 15, whose bottom is the level of the floor 16 of said chamber 1 of said oven 2. The height or width of the vertical surface defining internally said parallel steps 14-14 all along their length, is adequate to act as a stop ledge for restraining the plate 17 in its position in which it blocks said opening 12 (from the inside) of said oven 2 by means of its external face or front surface 18 (see FIGS. 6 and 7) in its lateral movements, apart from allowing, due to its width, sufficient free space in the top and in the bottom, for an easy travelling of said plate 17.

The space resulting from the thickness of said plate 17 plus the width of the surface of the upper step 14 must be adjusted to a space equal to one fourth of the circumferential thickness of a cylindrical axle 19 which is vertically and longitudinally attached to one of the lateral ends of said plate 17, where its outer vertical tangent 20 (see FIG. 10) should not exceed the line of the outer vertical surface 26 of the external contact surface of the edges 223 of the back 4 of the door 3 of said oven 2.

Said axle 19 of said plate 17 is removable by its attachment or removal from its other circumferential inner means, projected vertically or longitudinally through the lateral edge 25 of a semi-concavity 26, the introduction of said revolving assembly being made through the respective protruding ends 27 of said axle 19 (FIG. 7). The outer surface 28 of said plate 17 is completed also with two parallel guiding channels 29, which coincide with the arrangement and levels of those provided on the back 4 of the door 3 of said oven 2, which permits the engagement of said door 3 with said plate 17 through said guiding channels 29 and said guiding channels 5 which engage with the outer edge of their longitudinal side the respective guiding channels 6 with an inverted "U" shape provided on the straight sides of said racks 7, thus forming with said door 3 and said closing inner plate 17, a dihedral angle. This forms a semi-revolving assembly around said axle 19 which moves each time the door 3 is opened or closed. This permits the placement of racks 7 with the food being cooked outside said chamber 1, and while the rack remains in this position, said plate 17 closes the oven opening from the inside, contacting its edges 18 along the surface of said step 14, while the door 3 remains open. The surface of the semi-concavity 26, which is disposed in the wall 9 adjacent a junction between the wall 9 and the front wall containing the opening 12, forms a recess which receives the axle 19 of the plate 17.

When the food is re-introduced inside the chamber 1 for baking by closing the door 3, said inner plate 17 is placed adjacent to the support 30 of the straight lateral wall 9, said arrangement being completely removable without involving any physical effort, by first just lifting said racks 7 not more than one centimeter to remove them, and then repositioning said plate 17 adjacent support 30 and pressing the fingers behind the protruding portion 31 of the axle 19, which is perpendicular to the plate 17 which, being pulled outwards will slide out until it is totally removed. To reposition it, both ends 32 of the free lateral guiding channel 33 of said plate 17 must be introduced through the opening 15 next to the steps 14,14, attaching said free lateral 33 into the support 30 of the lateral straight wall 9 and continuing to make it slide inwards until the protruding ends 27 of the axle 19 of said plate 17 are introduced through their respective openings 15 in both steps 14-14 and thus continuing until said inner semi-cylindrical part of said axle 19 is attached to said semi-concavity 26. Then, said plate 17 must be turned until the oven opening 12 is closed, engaging the lateral guiding channel 6 of a rack 7 to plate 17, pulling said door 3 of said oven 2 until a dihedral angle is formed with said plate 17, placing said remaining lateral guiding channel 6 of said rack 7 in its respective guiding channel 5 provided at the back 4 of said door 3, completing said semi-rotating assembly with the remaining rack 7.

Having defined the conformation of said side called straight wall 9, which outer end 25 projects beyond said semi-concavity 26 in which it is engaged, and in which the inner-longitudinal semi-circle 35 of axle 19 rotates, completing said semiconcavity 26 a portion of vertial front surface 36 of attachment to the lateral edge of the back 4 of door 3, being said surface 36 contained in a tangent plane 20 of said axle 19, completing the remaining contour of said oven opening 12 with the outer vertical surface 21 of the upper step 14, which contacts the edges 23 of the protruding portion of the back 4 of the door 3 and continuing with the lower step 14 which vertical surface 22 contacts the contours of said edges 23, and the vertical space 13 of the side on which the door rotates is conformed in all height by a semi-concavity which two ends are defined by an orifice 37 each, the lower one made through the floor 16 and the upper one through the protruding portion of the top of the chamber 1, being said upper orifice 37 defined by an outer front wall 38 of a minimum thickness.

The upper end 39 of the axle of the door 3 is separated from a portion of said door by an opening 41, to permit said upper end 39 to be totally introduced through the upper orifice 37.

To remove said door 3, as previously described, said door must be free of racks 7 and placed perpendicularly with respect to the front of the oven 2 and in said position, pressing said door 3 upwards, wall 38 will be gradually introduced all the way into the opening 41 of said door 3, which will allow the lower end 40 of said door 3 to be disengaged from lower orifice 37, thus permitting the detachment of the door away from the front plane of the oven 2, and pressing the door 3 downwards it will be easily and completely removed.

Said closing plate 17 can be removed as many times as necessary by simply pulling it outwards, with no need to remove the door 3.

What is claimed is:

1. An oven, comprising:

a plurality of upright walls defining an inner chamber, a first of the walls defining a front wall provided with an opening through which access may be had to the inner chamber, the opening including a first vertical axle extending along one side thereof, a second of the walls extending rearwardly from the first wall;

a door pivotally supported along said first vertical axle to be movable between a first door position extending across the opening for closing the inner chamber and a second door position opening the inner chamber, the door having an inner door surface facing rearwardly and exposed to the inner chamber when the door is in the first door position; an inner plate pivotally supported along a second vertical axle parallel to the first vertical axle and located within the inner chamber, the inner plate being movable between a first inner plate position adjacent the second wall of the oven and a second inner plate position adjacent the opening, the inner plate including a front surface facing the inner chamber when the inner plate is in the first inner plate position;

at least one rack adapted for supporting materials to be heated in the oven; and means for supporting the rack between the front surface of the inner plate and the inner door surface, so that the door and the inner plate move together with the rack when the door is moved forwardly from the first door position to the second door position and so that when the door is in the second door position the rack is located outside the inner chamber and the chamber is closed by the inner plate;

the second wall including a concavely curved surface disposed adjacent a junction between the first and second walls, the curved surface forming a recess for receiving the second vertical axis.

2. The oven according to claim 1, wherein the walls defining the inner chamber include a third upright wall extending rearwardly from the first wall, the second and third walls defining chamber surfaces which are free of attachments.

3. The oven according to claim 1, further including a protruding stop ledge extending around at least a portion of the periphery of the opening and arranged to be abutted by the front surface of the inner plate when the inner plate is in the second inner plate position.

4. The oven according to claim 3, wherein the protruding peripheral stop ledge is located about the opening except adjacent upper and lower ends of the second vertical axle for forming an opening channel for mounting and demounting the second axle and the plate.

5. The oven according to claim 4, wherein the door has a vertical slot formed therein adjacent to and parallel to the first vertical axle.

6. The oven according to claim 1, wherein the rack is slidably supported on the supporting means.

7. An oven, comprising:

a plurality of upright walls defining an inner chamber, a first of the walls defining a front wall provided with an opening through which access may be had to the inner chamber, the opening including a first vertical axle extending along one side thereof, a second of the walls extending rearwardly from the first wall; a door pivotally supported along said first vertical axle to be movable between a first door position extending across the opening for closing the inner chamber and a second door position opening the inner chamber, the door having an inner door surface facing rearwardly and exposed to the inner chamber when the door is in the first door position;

an inner plate pivotally supported along a second vertical axle parallel to the first vertical axle and located within the inner chamber, the inner plate being movable between a first inner plate position adjacent the second wall of the oven and a second inner plate position adjacent the opening, the inner plate including a front surface facing the inner chamber when the inner plate is in the first inner plate position; at least one rack adapted for supporting materials to be heated in the oven;

means for supporting the rack between the front surface of the inner plate and the inner door surface, so that the door and the inner plate move together with the rack when the door is moved forwardly from the first door position to the second door position and so that when the door is in the second door position the rack is located outside the inner chamber and the chamber is closed by the inner plate; and a protruding stop ledge extending around at least a portion of the periphery of the opening and arranged to be abutted by the front surface of the inner plate when the inner plate is in the second inner plate position, the stop ledge terminating short of the second vertical axle.

8. The oven according to claim 7, wherein the walls defining the inner chamber include a third upright wall extending rearwardly from the first wall, the second and third walls defining chamber surfaces which are free of attachments.

9. The oven according to claim 7, wherein the rack is slidably supported on the supporting means.

10. The oven according to claim 9, wherein the walls defining the inner chamber include a third upright wall extending rearwardly from the first wall, the second and third walls defining chamber surfaces which are free of attachments.

* * * * *